US005400223A

United States Patent [19]

Speaker et al.

[11] Patent Number: 5,400,223

[45] Date of Patent: Mar. 21, 1995

[54] SPORTS LIGHTING LUMINAIRE HAVING A BROKEN GLASS SAFETY SHUTDOWN CIRCUIT

[75] Inventors: Lawrence W. Speaker; George E. Kiefer, both of Hendersonville; Samuel L. Baldwin, E. Flat Rock, all of N.C.

[73] Assignee: General Electric Company, Schenectady, N.Y.

[21] Appl. No.: 91,931

[22] Filed: Jul. 14, 1993

[51] Int. Cl.[6] ..... F21V 25/04

[52] U.S. Cl. ..... 362/21; 362/276; 315/73

[58] Field of Search ..... 362/21, 276, 802; 315/73, 74, 360

[56] References Cited

U.S. PATENT DOCUMENTS

| | | | |
|---|---|---|---|
| 2,313,165 | 3/1943 | Nelms et al. | 362/21 |
| 2,535,819 | 12/1950 | Stamper | 362/21 |
| 4,276,580 | 6/1981 | Rogers | 362/276 |
| 4,937,717 | 6/1990 | Betzvog, Jr. | 362/276 |
| 5,289,352 | 2/1994 | Remos et al. | 362/21 |

*Primary Examiner*—Richard R. Cole

*Attorney, Agent, or Firm*—George E. Hawranko; Stanley C. Corwin

[57] ABSTRACT

A sports lighting fixture having a broken glass detection arrangement includes a high intensity light source disposed near the closed end of a reflector member. A cover member made of a light transmissive material is disposed at the open end of the reflector and is effective for filtering UV radiation emitted by the light source. A ballast circuit has in input portion receptive of line power and an output portion effective for conditioning the line power to energize the light source. A conductor strip is disposed on the cover member and is effective such that, when the cover member is intact, an electrical signal can be passed therethrough. An interruption circuit arrangement is electrically coupled into the ballast circuit and has the conductive strip disposed therein so that, upon the occurrence of an open condition in the conductive strip, indicative of a broken glass condition, the interruption circuit arrangement is effective for interrupting current flow in the ballast circuit thereby resulting in a shutdown of power to the light source and the consequent prevention of further UV emission until such time as the cover member is replaced.

20 Claims, 3 Drawing Sheets

SPORTS LIGHTING LUMINAIRE HAVING A BROKEN GLASS SAFETY SHUTDOWN CIRCUIT

FIELD OF THE INVENTION

This invention relates to a sports lighting luminaire having a broken glass safety shutdown circuit. More particularly, this invention relates to such a sports lighting luminaire which exhibits improved photometric performance using an arc tube in a parabolic reflector, the luminaire having a tempered glass cover to provide filtering of ultraviolet radiation (UV) and wherein a safe and cost efficient circuit is provided to insure that upon breakage of the cover, the light source is shut down so as to substantially prevent the emission of UV.

BACKGROUND OF THE INVENTION

Architectural lighting designers, faced with the task of uniformly and efficiently illuminating the playing surface of a sports field while minimizing the amount of light spilled into the seating portion of the sports field, have utilized individual lighting fixtures that would be of a type that utilized a large light source having an arc tube disposed within an outer envelope that was oriented along the central axis of the light source. The light output pattern of such a fixture would be of a circular shape such that, once directed onto the playing surface of a sports field, resulted in an essentially elliptically shaped light pattern with varying amounts of light intensity around such elliptical shape. This approach suffers in terms of light utilization and the amount of spill light experienced; that is, the amount of light that goes beyond the playing surface and into the eyes of the spectators and in worst cases, beyond the confines of the sports field to surrounding homes and businesses. Because this fixture utilized a light source along the central axis of the reflector with little regard for the amount of light exiting the fixtures at high angles thereby resulting in such spill light, the size constraint of an outer jacket to the light source was not of critical consideration and such outer jacket could be utilized for the purpose of UV filtering from the arc tube disposed within the outer jacket. Although this approach has proven effective in providing a means of filtering UV radiation emitted by the high intensity light source, the consequences of such an approach in terms of light utilization and spill light has had adverse effects. For instance, since the elliptical light pattern results in an inefficient combination of patterns at the playing field surface, there is the need to increase the actual number of fixtures needed to illuminate a particular area and the need to provide external light directing devices such as glare shields and louvers. U.S. Pat. No. 4,725,934 issued to Gordon et al on Feb. 16, 1988, discloses a fixture using an outer jacketed light source disposed along the longitudinal axis of a reflector as well as external louvers and a glare shield for redirecting light otherwise falling at higher output angles than desired. A sports lighting luminaire presently offered by GE Lighting Systems Department of General Electric Company under the product name "UltraSport" provides a solution to the problem of efficiency of light output and the reduction of spill light or glare. In attempting to improve the light delivery characteristics of sports lighting luminaires, the assignee of the present invention has developed the new sports lighting luminaire wherein a high intensity light source is utilized within a parabolically shaped reflector. In order to prevent the emission of UV radiation from such light source, the sports lighting luminaire uses a tempered glass cover for filtering UV.

One problem with the use of a separate cover member to serve the purpose of UV filtering is that, should the cover be broken for instance by vandalism or by accident relating to the sporting event at the field, and the light source remain intact and operating, UV would be emitted from the luminaire. It would therefore be advantageous that, in the event of breakage of the cover member to the luminaire, a means could be provided to insure that the light source is prevented from operating and emitting UV. One approach to solving this problem can be found in publications by Philips Lighting relating to their sports lighting luminaire identified as the "ArenaVision" luminaire. In this approach, a wire mesh grid is disposed within the glass material of the cover member similar to the type of safety glass previously utilized in commercial retail operations in doors and windows. Though effective for insuring the integrity of the glass cover and preventing the glass cover from scattering away from the open end of the luminaire, this approach has the adverse effect of blocking or obscuring the light output from the luminaire even when the cover is intact Furthermore, since this technique is directed to maintaining the positioning of the glass cover even in the event of breakage, rather than interrupting the operation of the light output, it could be possible that portions of the glass cover could be displaced resulting in some leakage of UV. It would therefore be advantageous if an approach could be used that would continuously monitor the integrity of the glass cover but at the same time, not obscure light output therethrough when the glass cover was intact under normal conditions.

It can also be appreciated that if one took the approach of monitoring the condition of the glass cover so as to provide such condition as a logic input to the ballast arrangement used to power the light source, one could positively insure that the shutdown of the lamp operation under a broken glass cover condition, did occur. Therefore, not only would it be desirable to prevent the displacement of broken glass pieces by some means other than a light blocking wire mesh grid technique, it would also be beneficial to positively utilize the information that the glass has been broken as an operating input to the ballast arrangement of the luminaire. In providing a circuit control based on the condition of the cover glass, the cost of such an addition of logic elements, the number of components needed to perform this logic check, as well as the reliability of such a circuit would be of considerable importance. Therefore, it would be advantageous if a circuit to verify the integrity of the cover glass and thereby serve to insure the shutdown of the light source in the event of a broken glass condition, could be provided in an manner that was cost effective, used a minimum number of components and was extremely reliable in operation.

SUMMARY OF THE INVENTION

The present invention provides a sports lighting luminaire having broken glass detection arrangement which provides that in the event of a break in the cover glass which normally serves the purpose of filtering UV radiation, the ballast circuit arrangement which powers the light source will be disabled thereby preventing the emission of UV until the cover glass is replaced. The broken glass detection arrangement for the sports lighting luminaire of the present invention provides an integrity check of the cover glass without imposing any light blocking characteristics therewith.

In accordance with the principles of the present invention, there is provided a luminaire having a reflector member with an open end and a closed end and wherein a high intensity light source is disposed near the closed end of the reflector member. A light transmissive cover member is disposed over the open end of the reflector member and is effective for filtering UV radiation emitted by the light source. The luminaire of the present invention includes a ballast circuit arrangement disposed in a ballast housing which can be connected to the reflector member. The ballast circuit arrangement includes an input portion receptive of line power and an output portion effective for conditioning the line power so as to provide conditioned power for energizing the light source. A conductor strip is disposed on the cover member and is effective so that, when the cover member is intact; that is, not broken, an electrical signal can be passed through the conductor strip. An interruption circuit arrangement is electrically coupled into the ballast circuit arrangement and is effective for interrupting current flow in the ballast circuit when the electrical signal through the conductor strip is detected as being absent thus indicating a broken glass condition. When the current flow in the ballast circuit arrangement is interrupted, the conditioned power generated in the ballast circuit arrangement is shutdown thereby effectively shutting down the operation of the light source and preventing any further emission of UV when the cover member is in a broken condition.

BRIEF DESCRIPTION OF THE DRAWINGS

In the following detailed description, reference will be made to the attached drawings in which.

DETAILED DESCRIPTION AND OPERATION

Figure 1:
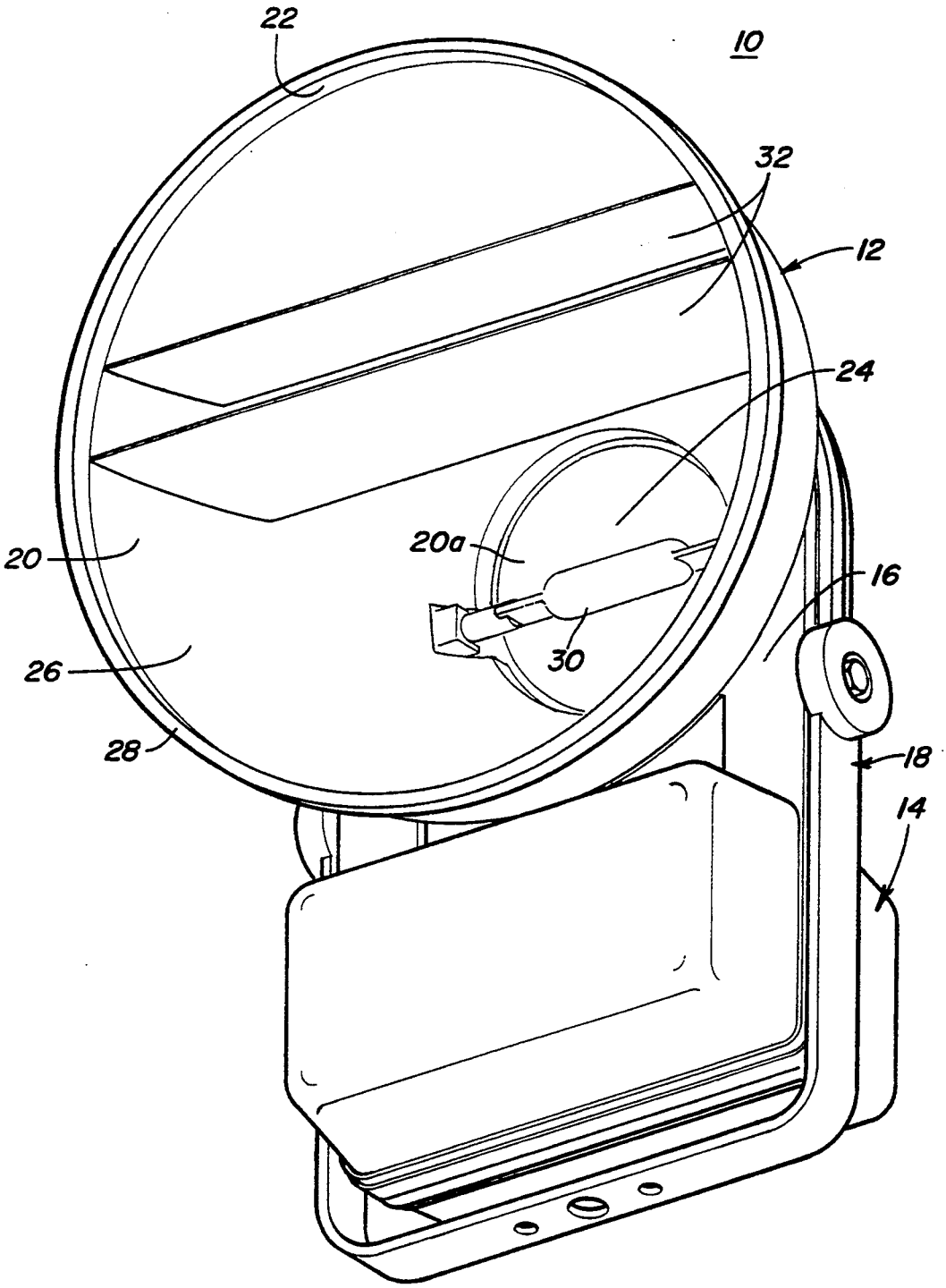
FIG. 1 is an isometric view of a sports lighting luminaire constructed in accordance with the principles of the present invention.

As seen in FIG. 1, the luminaire 10 having improved light delivery characteristics particularly suited for a sports lighting application and with the broken glass detection arrangement of the present invention includes an optical portion shown generally as 12, a ballast and ballast housing portion shown generally as 14 and a support arrangement 16. The support arrangement 16 physically connects the optical portion 12 to the ballast, housing portion 14. Additionally, the support arrangement connects to a mounting configuration 18 which serves the purpose of providing an adjustment means for setting the downward projecting angle of the luminaire 10 when in an installed environment. By separating the ballast portion 14 from the optical portion 12, a thermal isolation between such two portions is achieved. It should be recognized however, that the ballast portion 14 and optical portion 12 could be formed using an integral housing arrangement that utilized an alternate thermal isolation arrangement. Additionally, it can be appreciated that the ballast circuit arrangement could be disposed remotely from the optical portion; for instance, the ballast and housing therefor could reside at the base of a mounting pole with the optical portion at the top of the pole and electrically connected therebetween by means of conventional electrical cabling. It is contemplated that both such luminaire configurations would still be covered by the present invention particularly relative to the broken glass detection arrangement of the present invention.

The optical portion 12 includes a reflector member 20 which can be constructed of a non-metallic material and is shown in the shape of a paraboloid of revolution. In the present invention, reflector 20 is constructed having a glass substrate material with a dichroic or multifilm interference coating disposed thereon. Other reflector configurations made of alternate materials could be utilized by someone skilled in the art and still practice the teachings of the present invention; for instance, the reflector could be elliptically shaped and it could be constructed of aluminum. In the preferred manner using the glass substrate and multifilm interference coating, the reflector member 20 can achieve reflectance of approximately 95% of the light generated by the light source as compared to the 75–85% value typically achieved using an aluminum reflector. With the parabolic Configuration of reflector 20, an open end 22 is formed at one end of the parabola, an apex end 24 is formed opposite the open end 22, and a central axis extends therebetween. A cover member 26 is fitted over the open end 22 and secured to the reflector member 20 by means of a ring member 28. The cover member 26 is made of tempered glass and is effective for filtering unwanted UV radiation which is given off by the light source 30 disposed within the reflector member 20. The cover member 26 can also be formed from a molded borosilicate material that would provide sufficient light transmissivity as well as avoidance of the shattering and spraying of broken glass pieces if the cover member is broken.

The light source 30 is disposed within the reflector member 20 so as to be in close proximity to the apex end 24 of the reflector 20. The light source 30 of the preferred embodiment is a double ended, high intensity discharge (HID) lamp having a bare arc tube wall made of fused quartz and containing a metal halide fill which is excited to a discharge state thereby producing an elongated arc discharge within the arc tube. The light source 30 is disposed at a juncture point between the main reflector portion 20 and the rear reflector portion **20*a* so that, upon opening the rear reflector portion 20*a*, access can be had to the light source 30** from the rear. Of course, it can be appreciated that other light source types and orientations of such light sources relative to the reflector member can be utilized in conjunction with the broken glass detection arrangement of the present invention and it is contemplated that such modifications are within the scope of the present invention.

As further seen in FIG. 1, disposed along the upper half of the reflector member 20 is a series of substantially equally spaced apart louver members 32. These louver members 32 provide a means for redirecting light output that would otherwise exit the open end 22 at a large angle relative to the central axis, into a smaller such angle thereby allowing the lighting designer the ability to reduce glare or spill light from areas above the playing surface of the sports field.

Figure 2:
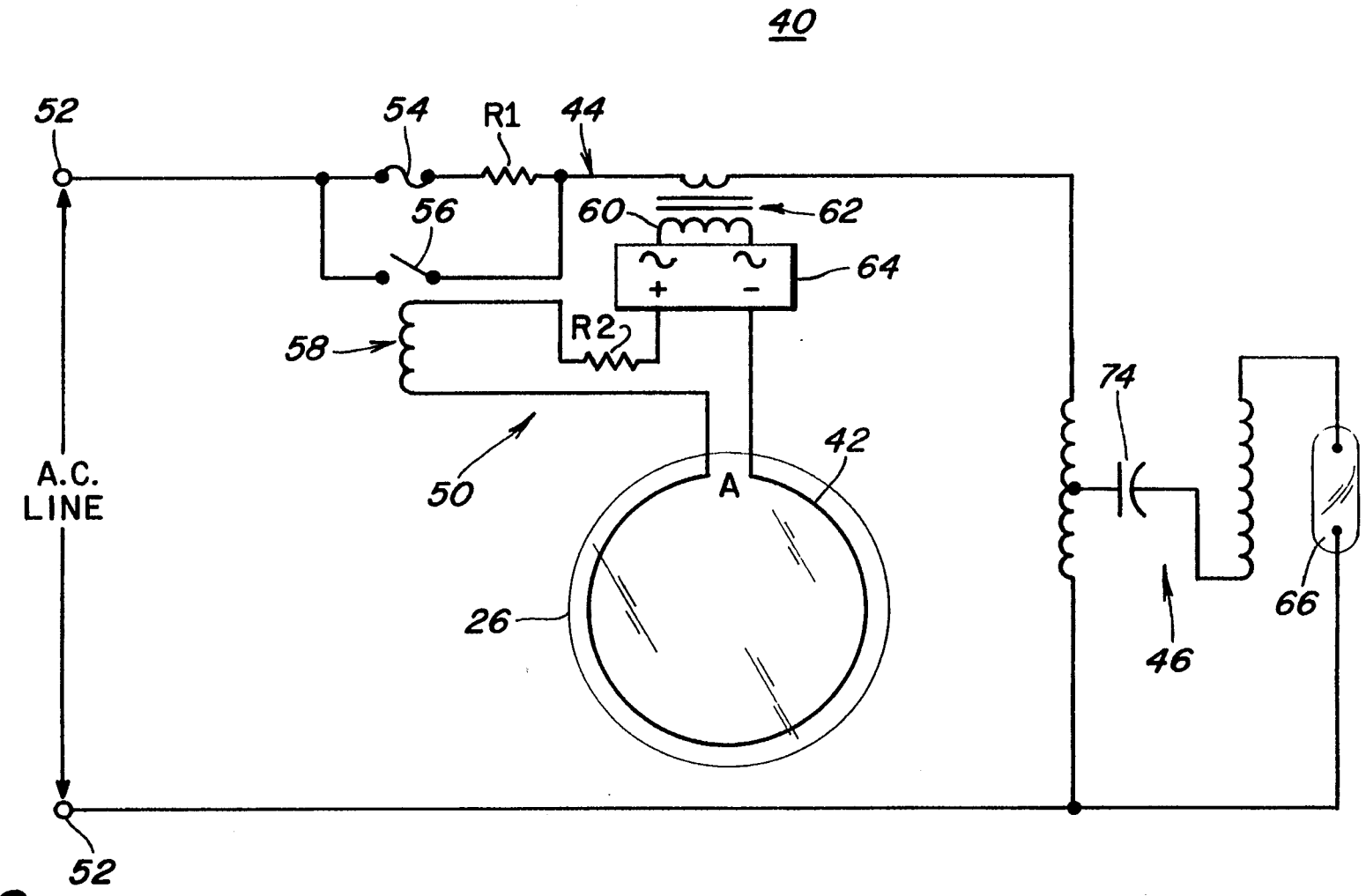
FIG. 2 is a circuit representation of the broken glass detection arrangement for the sports lighting luminaire of FIG. 1 constructed in accordance with one embodiment of the present invention.

As seen in FIG. 2, the broken glass detection circuit arrangement 40 of the present invention, includes the cover member 26 from FIG. 1 as well as a conductive strip 42 which is shown disposed along the outer periphery of the cover member 26. The broken glass detection arrangement of the present invention could be equally effective wherein a protective jacket or cover over the light source 30 were utilized rather than merely a cover over the open end 22 of the reflector 20. The conductive strip 42 can be provided by means of a thin resistive material strip similar to that used for resistive heating on a automotive rear window defogger. However, in the present situation, because the conductive strip 42 is not intended to serve as a heating element and further because it is preferable that the conductive strip 42 not act to block light output through the cover member 26, it would be sufficient to provide such conductive strip 42 as a very thin coating of such resistive material. The resistance of this conductive strip can be selected such that there is sufficient conductivitiy yet the size and thickness does not block light output; in this arrangement, the conductive strip was selected as having approximately 20 ohms resistance. This material is disposed in a thin layer and is brittle in nature so that, when the cover member 26 is broken, the conductive strip 42 will break as well. Furthermore, the conductive strip 42 is disposed preferably on the inner surface of the cover member 26 so that it is shielded from climate conditions and can therefore maintain a strong electrical coupling relationship with the rest of the circuit arrangement 40 over a prolonged period of time. It can be appreciated that although the conductive strip 42 is shown disposed around the periphery of the cover member 26, it would be possible to dispose such conductive strip 42 in an alternate position and still achieve a breakage in the conductive strip 42 upon a breakage in the cover member 26. For instance, since the conductive strip 42 is a thin coating of the above described material and therefore will not serve to block light output from the light source 30, the conductive strip 42 can be disposed in a criss-crossing manner across the surface of the cover member 26.

As further seen in FIG. 2, the ballast circuit arrangement 40 having the broken glass detection circuit 50 of the present invention includes a conventional auto-regulation transformer 46 and a ballast capacitor 74. Of course, it can be appreciated that other ballasting arrangements such as a convention transformer coupling configuration could be utilized in conjunction with the present invention. As illustrated in FIG. 2, the broken glass detection circuit 50 of the present invention is disposed on the primary side or input portion 44 of the auto-regulation transformer 46 and as such, receives input power directly from input terminals 52. Disposed electrically adjacent one input terminal 52 is a fuse member 54. The fuse member 54 is sized so as to provide the circuit protection whereby, under conditions when the fuse member 54 is not bypassed as will be discussed hereinafter in further detail, a current in excess of a predetermined amount will be drawn through the input portion of the ballast circuit arrangement 40 for a specific period of time as would indicate the occurrence of a broken glass condition, resulting in blowing the fuse member 54. As an example, the fuse member 54 could be rated to blow at approximately 4 amps such that when a nominally rated current flows through fuse member 54 for a period of greater than approximately 100 msecs, fuse member 54 will blow. Before the expiration of the 100 msec time duration, even in the presence of a substantially higher current, the fuse member 54 could not thermally react and therefore would not blow even upon initiation conditions wherein the ballast circuit arrangement 40 draws an initial current pulse of up to 70 amps. Of course, it can be understood that these current valves are representational only and should not serve to limit the scope of the present invention. Other valves can be used depending on the lamp rating; it is only required that the current rating for the fuse 54 allow for a thermal delay as previously discussed.

A resistor R1 is connected in series with fuse member 54 and has a resistive value selected so as to increase the voltage drop seen by a contact member 56. Connected in an electrically parallel relation to the fuse member 54 and resistor R1 is a contact member 56 which is associated with a relay coil 58. Resistor R1 raises the voltage drop across contact member 56 so that even in a situation where an oxide coating may have formed on the contact surfaces, there is sufficient voltage to ensure that current transfers from the fuse member 54 to the contact member 56 as soon as the contacts close. Contact member 56 is normally open so that when the relay coil 58 is not energized, current for the input portion 44 of the ballast circuit arrangement 40 will flow through fuse member 54. In this manner, upon initiation of the ballast circuit arrangement 40 wherein current has not yet flowed in the loop containing relay coil 58, current will initially flow through the fuse member 54 until such time as the contact member 56 is closed. Once the contact member 56 is closed by energization of relay coil 58, current will flow through the contact member 56 rather than the fuse member 54. Contact member 56 can be rated for example at approximately 16 amps and can react in approximately 16 msecs. As previously discussed, since fuse member 54 cannot thermally react within 100 msecs of having a high current flowing therethrough the fuse member 54 is capable of handling the initial high current pulse whereas the contact member 56 cannot. After the drop-off of the initial current pulse, the contact member 56 essentially short circuits the fuse member 54 substantially before the expiration of the 100 msec time period. That is, since the contact member 56 is rated at 16 amps, by having the initial current pulse which can be up to 70 amps, flow through the fuse member 54 rather than the contact member 56, the contact member 56 is protected against welding as could otherwise occur in the presence of this high initial current pulse. In this manner the fuse member 54 and the contact member 56 cooperatively interact with one another so as to protect the other from damage due to current conditions associated with the respective initial conditions and continuous operations of ballast circuit arrangement 40. It should be appreciated that by using this type of cross-protection arrangement between fuse member 54 and contact member 56, the relay coil 58, contact member 56 device can be significantly reduced both in terms of size and cost as compared to the type of device that would otherwise have to be used if a relay contact were to be disposed in the input portion 44 so as to accommodate the high initial current pulse. For the contact member 56, relay coil 58 device of the present invention, it is possible to utilize a conventional low voltage, single pole relay available from either Potter Brumfield or Magnecraft as Model No. RKS-5DG or 76URCPCX, respectively, although other conventional relays would work equally as well.

Relay coil 58 as illustrated in FIG. 2 as part of the broken glass detection circuit 50, is in series electrical connection with the conductive strip 42 a second resistor R2, a diode bridge 64 and the secondary winding 60 of a second transformer member 62. In this series circuit, the second resistor R2 is used to match the voltage output of the second transformer member 62 to the input voltage requirements of relay coil 58. Additionally, diode bridge 64 has been added to convert the AC output of the second transformer member 62 to full wave DC suitable for operating relay coil 58. A primary winding 64 of transformer 62 is disposed in the input portion 44 of ballast circuit arrangement 40. This second transformer 62 is effective for sensing current flow in the input portion 44 of ballast circuit 40 and inducing a current flow in the broken glass detection circuit 50 thereby energizing relay coil 58 when current is flowing in the input portion 44. It should be noted that the ratio of windings for the second transformer 62 is selected so as to result in a low voltage signal being developed within broken glass detection circuit 50. The use of a low voltage signal thereby insures that arcing over does not occur as could otherwise occur in a high voltage condition for instance at point A as shown in FIG. 2. Use of the second transformer 62 along with the relay coil 58 is also effective for isolating the broken glass detection circuit 50 from the input portion 44 of the ballast circuit arrangement 40; that is, with the contact member 56 and the primary winding 64 being disposed in the input portion 44 of the ballast circuit arrangement 40, the current flowing in input portion 44 is isolated from that which flows in the broken glass detection circuit 50. As a further condition to the continued energization of relay coil 58, the conductive strip 42 must remain intact thereby indicating that the cover member 26 has not been broken. In the event that the cover member 26 is broken resulting in the conductive strip 42 being broken, there is no longer continuity in the broken glass detection circuit 50 and the relay coil 58 will be de-energized thereby resulting in the opening of contact member 56. With contact member 56 open and current continuing to flow in the input portion 44 of ballast circuit 40, the magnitude of such steady state current flow in input portion 44 will be sufficient to blow fuse member 54 after the 100 msec. time period previously described. In this manner, the contact member 56 opens first so that the fuse member 54 interrupts current flow rather than the contact member having to do so. Current flow in the input portion 44 is thereby interrupted resulting in the interruption of current flow through the auto-regulation transformer 46 and the shutdown of light source 30.

Following the shutdown of the light source 30 in the event of a broken glass condition, if one would attempt to restart the luminaire, it would be necessary to replace fuse member 54 as well as to replace the cover member 26; replacement of one such device without the replacement of the other would be ineffective toward the goal of restarting the luminaire 10.

Figure 3:
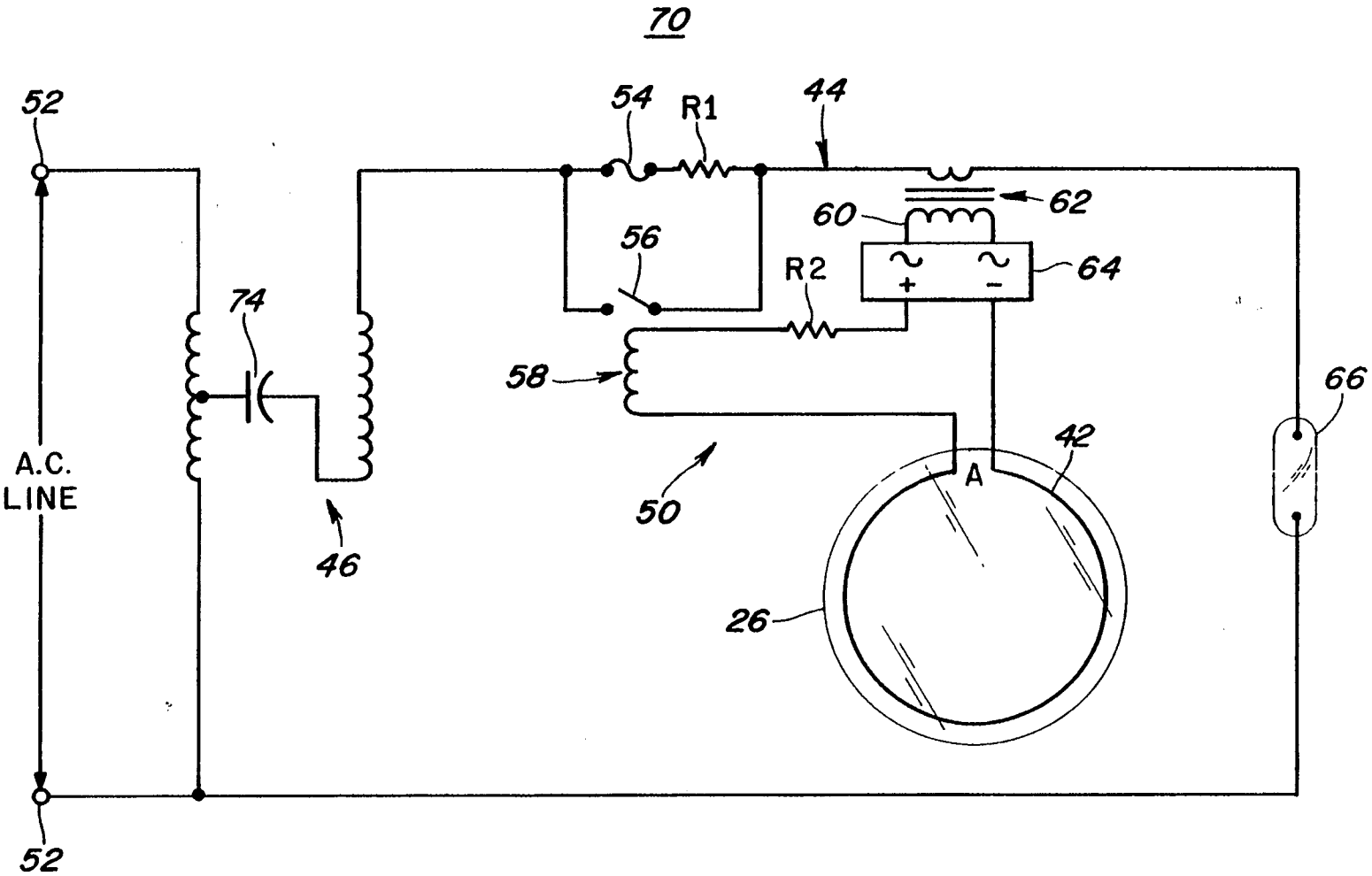
FIG. 3 is a circuit representation of a broken glass detection arrangement for the sports lighting luminaire constructed in accordance with the preferred embodiment of the present invention.

As seen in FIG. 3, the broken glass detection circuit 50 of the present invention is disposed in the output portion 48 of ballast circuit 40. The circuit arrangement 50 of FIG. 3 is identical to that of FIG. 2 except that the broken glass detection circuit 50 is energized off of the secondary winding of auto-regulation transformer 46 rather than through input terminals 52. Although the broken glass detection circuit 50 will function equally as well whether disposed in the input portion 44 or the output portion 48, it is to be appreciated that disposition in the output portion 48 is the preferred arrangement. This output side disposition allows for selection of component sizes and tolerances based only on the secondary current characteristics (as dictated by the wattage selected for lamp 66). If disposition on the input side were chosen, component values would change for the various nominal line voltage ratings at which the particular one lamp wattage could operate.

Although the hereinabove described embodiment of the invention constitutes the preferred embodiment, it should be understood that modifications can be made thereto without departing from the scope of the invention as set forth in the appended claims. For instance, the values given for the current ratings on fuse member 54 and contact member 56 are exemplary only and are not intended to limit the scope of the present invention. It is contemplated that when the ballast circuit arrangement is altered in terms of energy output to accommodate a different wattage of light source, commensurate changes in the size and time response characteristics of the components illustrated in FIG. 2 can be made without departing from the scope of the present invention.

We claim:

1. A luminaire comprising:

a housing member having an open end;

a high intensity light source disposed within said housing member;

a light transmissive cover member disposed so as to cover at least a portion of said light source and being effective for filtering UV radiation emitted from said light source;

ballast means receptive of line power and effective for conditioning such line power so as to provide conditioned power for energizing said light source;

a conductor strip disposed on said cover member and being effective such that, when said cover member is intact, an electrical signal can be transmitted therethrough; and interruption means electrically coupled to said ballast means and having said conductive strip connected therein, said interruption means being effective for interrupting current flow in said ballast means upon the occurrence of an open condition in said conductor strip, such interruption in current flow said ballast means resulting in a shutdown of such conditioned power to said light source.

2. The luminaire as set forth in claim 1 wherein said housing member is a reflector and said light source is disposed near a closed end of said reflector.

3. The luminaire as set forth in claim 2 wherein said cover member is constructed from tempered glass and is disposed over said open end of said reflector member.

4. The luminaire as set forth in claim 1 wherein said conductive strip is constructed of a thin coating of a resistive material and is disposed on a side of said cover member which faces said light source, said coating being of a thickness so as to avoid blockage of a consequential amount of light output from said light source.

5. The luminaire as set forth in claim 4 wherein said resistive material is disposed on the surface of said cover member in a sputtered, manner so that upon the occurrence of a breakage in said cover member, said resistive material exhibits brittle characteristics and breaks in a substantially simultaneous manner with said cover member.

6. The luminaire as set forth in claim 3 wherein said conductive strip is disposed along an outer periphery of said cover member.

7. The luminaire as set forth in claim 1 wherein said ballast means includes an input portion and an output portion and said interruption means is disposed in said output portion.

8. The luminaire as set forth in claim 1 wherein said interrupting means includes a fuse member and a relay contact disposed in electrically parallel relation to one another.

9. The luminaire as set forth in claim 8 wherein said interrupting means further includes a circuit loop having disposed in a series electrical connection therein, said conductive strip, a relay coil effective for controlling operation of said relay contact, and a secondary winding of a second transformer member disposed in said ballast means.

10. The luminaire as set forth in claim 9 wherein said circuit loop is isolated from current flow in said ballast means by virtue of a transformer coupling provided by said second transformer and by said relay coil to said relay contact.

11. The luminaire as set forth in claim 8 wherein said fuse member is selected so as to have a current rating associated therewith and a thermal delay characteristic whereby, upon occurrence of an initial current pulse substantially higher than the current rating of said fuse member, said fuse member is delayed from blowing for a predetermined period of time.

12. The luminaire as set forth in claim 11 wherein such predetermined period of time is such that, before expiration thereof, said relay contact can be closed thereby bypassing said fuse member and preventing the blowing thereof.

13. The luminaire as set forth in claim 11 wherein said relay contact is selected so as to have a current handling capacity that is substantially less than the magnitude of such initial current pulse, said relay contact member being in an open condition until such time as such initial current pulse subsides to a steady state current level, and wherein a resistor member is disposed in series electrical relation to said fuse member and parallel electrical relation to said relay contact member.

14. A luminaire having a broken glass detection arrangement comprising:

a reflector member having an open end;

a high intensity light source disposed within said reflector member;

a cover member disposed so as to cover at least a portion of said light source, said cover member being effective for filtering UV radiation emitted by said light source;

ballast means receptive of line power and being effective for converting such line power into conditioned power operable for energizing said light source;

a conductive strip disposed on at least a portion of said cover member, said conductive strip being effective such that, in the event of a breakage of said cover member, an electrical signal normally passed through said conductive strip during normal operation of said luminaire, is interrupted;

interrupting means coupled to said ballast means and effective for interrupting current flow in said ballast means upon detecting the absence of said electrical signal indicative of the occurrence of such breakage condition of said cover member; and wherein said interrupting means includes a fuse member and a relay contact arranged in parallel electrical relation to one another, said fuse member being normally bypassed by said relay member during steady state operating conditions of said ballast means.

15. The luminaire as set forth in claim 14 wherein said conductive strip is constructed of a thin coating of a resistive material and is disposed on a side of said cover member which faces said light source, said coating being of a thickness so as to avoid blockage of a consequential amount of light output from said light source.

16. The luminaire as set forth in claim 14 wherein said interrupting means further includes a circuit loop having disposed in a series electrical connection therein, said conductive strip, a relay coil effective for controlling operation of said relay contact, and a secondary winding of a second transformer member disposed in said ballast means.

17. The luminaire as set forth in claim 14 wherein said fuse member is selected so as to have a current rating associated therewith and a thermal delay characteristic whereby, upon occurrence of an initial current pulse substantially higher than the current rating of said fuse member, said fuse member is delayed from blowing for a predetermined period of time.

18. The luminaire as set forth in claim 17 wherein such predetermined period of time is such that, before expiration thereof, said relay contact can be closed thereby bypassing said fuse member and preventing the blowing thereof.

19. The luminaire as set forth in claim 18 wherein said relay contact is selected so as to have a current handling capacity that is substantially less than the magnitude of such initial current pulse, said relay contact member being in an open condition until such time as such initial current pulse subsides to a steady state current level.

20. A lamp ballast arrangement having a broken glass detection circuit, aid lamp ballast arrangement comprising:

input terminals receptive of line power;

output terminals connected to a high intensity light source;

ballast means connected between said input terminals and said output terminals and being effective for conditioning such line power so as to energize said light source;

interruption means coupled to said ballast means and effective for interrupting current flow to said output terminals upon detecting the absence of a signal indicative of a safety feature associated with said light source; and wherein said interrupting means includes a relay member and a fuse member arranged in parallel electrical relation to one another, said fuse member having a thermal operating parameter associated therewith that allows conducting a high initial current pulse for a predetermined period of time without blowing and wherein said relay member has a closing speed associated therewith that allows bypassing said fuse member before expiration of such predetermined time.

* * * * *